US011756479B2

(12) United States Patent
Baumheinrich et al.

(10) Patent No.: US 11,756,479 B2
(45) Date of Patent: Sep. 12, 2023

(54) DISPLAY DEVICE WITH PIXELS AND CONTROL UNIT

(71) Applicant: OSRAM OPTO SEMICONDUCTORS GMBH, Regensburg (DE)

(72) Inventors: Thorsten Frank Baumheinrich, Altdorf (DE); Hubert Halbritter, Dietfurt (DE)

(73) Assignee: OSRAM OPTO SEMICONDUCTORS GMBH, Regensburg (DE)

( * ) Notice: Subject to any disclaimer, the term of this patent is extended or adjusted under 35 U.S.C. 154(b) by 41 days.

(21) Appl. No.: 17/434,320

(22) PCT Filed: Feb. 20, 2020

(86) PCT No.: PCT/EP2020/054534

§ 371 (c)(1),
(2) Date: Apr. 5, 2022

(87) PCT Pub. No.: WO2020/173810

PCT Pub. Date: Sep. 3, 2020

(65) Prior Publication Data

US 2022/0238064 A1 Jul. 28, 2022

(30) Foreign Application Priority Data

Feb. 27, 2019 (DE) ..... 10 2019 105 001.4

(51) Int. Cl.
*G09G 3/32* (2016.01)
*G09G 3/20* (2006.01)

(52) U.S. Cl.
CPC ..... *G09G 3/32* (2013.01); *G09G 3/2011* (2013.01); *G09G 3/2014* (2013.01);
(Continued)

(58) Field of Classification Search
CPC ..... G09G 3/2011; G09G 3/2014; G09G 3/32–3291; G09G 2300/0421;
(Continued)

(56) References Cited

U.S. PATENT DOCUMENTS 5,227,900 A * 7/1993 Inaba ..... G09G 3/3651 345/97
6,246,385 B1 * 6/2001 Kinoshita ..... G09G 3/3685 345/204

(Continued)

FOREIGN PATENT DOCUMENTS

DE 699 00 1 97 T2 11/2001
EP 1 587 056 A1 10/2005

(Continued)

OTHER PUBLICATIONS

International Search Report issued for corresponding International Patent Application No. PCT/EP2020/054534 dated Jun. 29, 2020, along with an English translation.

(Continued)

*Primary Examiner* — Nathan Danielsen
(74) *Attorney, Agent, or Firm* — HAUPTMAN HAM, LLP

(57) ABSTRACT

A display device includes pixels-arranged in an array with rows and columns, column lines, each connected to the pixels of one of the columns, row lines, each connected to the pixels of one of the rows, and a control unit connected to the column lines and the row lines. The control unit is configured to generate a column pulse for a selected one of the column lines and generate a data signal for a selected row line from the row lines. The data signal includes a set pulse which, when the pixel is set to a radiating state, is applied at least in part to the pixel connected to the selected column and row line when the column pulse is applied to the pixel, and drives the pixel such that a light emission of the pixel depends on the time offset between the column pulse and the set pulse.

19 Claims, 6 Drawing Sheets

(52) U.S. Cl.
CPC ..... *G09G 2300/0842* (2013.01); *G09G 2310/0221* (2013.01); *G09G 2310/0251* (2013.01)

(58) Field of Classification Search
CPC ..... G09G 2300/0426; G09G 2300/08; G09G 2300/0809–0819; G09G 2300/0833; G09G 2300/0842; G09G 2300/088; G09G 2310/0205; G09G 2310/021; G09G 2310/0221; G09G 2310/0243; G09G 2310/0248; G09G 2310/0251; G09G 2310/0267; G09G 2310/0275; G09G 2310/0281; G09G 2310/0283; G09G 2310/04; G09G 2310/06–062; G09G 2310/067; G09G 2310/08; G09G 2320/0209; G09G 2320/0228; G09G 2320/0233; G09G 2320/0247; G09G 2320/0252; G09G 2320/0626–064
See application file for complete search history.

(56) References Cited

U.S. PATENT DOCUMENTS 6,489,941 B1* 12/2002 Inage ..... G09G 3/3651 345/97
2002/0036605 A1* 3/2002 Kawashima ..... G09G 3/3216 345/76
2005/0231535 A1* 10/2005 Akima ..... G09G 3/3283 345/691
2006/0158572 A1 7/2006 Zhou et al.
2007/0210999 A1* 9/2007 Lee ..... G09G 3/2014 345/83
2011/0234563 A1* 9/2011 Kim ..... G09G 3/3433 345/211
2011/0260172 A1 10/2011 Koyama
2015/0221255 A1 8/2015 Qing et al.
2017/0243547 A1 8/2017 Bishop
2017/0330509 A1* 11/2017 Cok ..... G09G 3/2014
2017/0365228 A1 12/2017 Kwok et al.
2018/0357963 A1 12/2018 Gai et al.

FOREIGN PATENT DOCUMENTS

EP 1 833 037 A2 9/2007
GB 2549734 A 11/2017
WO 2003/038791 A2 5/2003

OTHER PUBLICATIONS

Written Opinion ssued for corresponding International Patent Application No. PCT/EP2020/054534 dated Jun. 29, 2020.

* cited by examiner

DISPLAY DEVICE WITH PIXELS AND CONTROL UNIT

CROSS REFERENCE TO RELATED APPLICATION

This application is a National Stage of International Application No. PCT/EP2020/054534, filed on Feb. 20, 2020, which designates the United States and was published in Europe, and which claims priority to German Patent Application No. 10 2019 105 001.4, filed on Feb. 27, 2019, in the German Patent Office. Both of the aforementioned applications are hereby incorporated by reference in their entireties.

The invention relates to a display device having a plurality of pixels and a control unit for driving the plurality of pixels.

Conventional controls for pixels of a display device work in a cross-matrix arrangement and with current dimming to influence the brightness by changing the intensity of the emitted light of the pixels. This is also referred to as analog dimming. It is used for OLEDs and LCDs, for example. Such a control is disadvantageous for LED displays because of the unfavorable influence on color location or color palette gamut.

The object is to provide a display device with an alternative control.

A display device according to claim 1 is provided for this purpose. It comprises a plurality of pixels, the pixels being arranged in an array having rows and columns. It further comprises a plurality of column lines respectively connected to the pixels of one of the columns, and a plurality of row lines respectively connected to the pixels of one of the rows. A control unit is connected to the plurality of column lines and adapted to generate a column pulse for a selected one of the plurality of column lines. The control unit is also connected to the plurality of row lines and adapted to generate a data signal for a selected row line from the plurality of row lines. The data signal includes a set pulse that, when the pixel is set to a radiating state, is applied at least in part to the pixel connected to the selected column line and row line when the column pulse is applied to the pixel, and drives the pixel such that a light emission of the pixel depends on the time offset between the column pulse and the set pulse.

This control enables the offset-dependent control of the display device with high dynamics. The light is emitted only when the set pulse is applied, provided that the column pulse is applied at the same time. If this occurs at an early point in time while the column pulse is applied, i.e. the offset is small, the radiation starts earlier than if the set pulse is only applied towards the end of the column pulse, i.e. the offset is larger. The pixel can be switched off by a reset pulse or automatically after a preset time. A pulse width concept that can be implemented with this, in which radiating and non-radiating periods alternate, allows the bit depth and gray gradation to be set and a dimming effect to be achieved. This pulse width modulation for active matrix pixels enables optimum image quality and allows pixel-fine control.

In one embodiment, the control unit is configured to adjust the time offset between the start of the column pulse and the start of the settling pulse to influence the emission duration.

Another degree of freedom results from the fact that the light emission depends on the amplitude of the set pulse and the control unit is suitable for adjusting the amplitude of the set pulse. This allows the intensity of the radiation to be changed.

In one embodiment, the control unit is configured to reset the pixel before setting it again so that it is in a non-radiating state and no light is emitted. The mandatory reset before each setting puts the pixel in a well-defined non-radiating rest state during which it does not emit, so that no interference with the previously set information occurs in the pixel electronics during subsequent setting. A pixel has a light-emitting semiconductor device and a pixel controller. If the pixel control has a capacitor as charge storage, and information storage, the reset results in its complete discharge before it is again charged by the set pulse.

In one embodiment, the control unit is configured to reset the pixel when a reset pulse is applied to the pixel if a column pulse is also applied to the pixel.

In an alternative embodiment, the pixel is configured to reset with a time delay to setting. In other words, the pixel is automatically reset to the non-radiating state after a predetermined time has elapsed without a reset pulse.

In one embodiment, the control unit is configured to generate as a data signal a bipolar pulse that is a sequence of the reset pulse followed by the set pulse, wherein when the column pulse is applied to the pixel, at least a portion of the sequence that is at least the reset pulse is also applied to the pixel. The bipolar pulse comprises a reset pulse with, for example, a negative sign, followed by a set pulse with an opposite, for example positive, sign, so that a reset occurs before each new set. Advantageously, the control unit is configured to adjust the distance between the reset pulse and the set pulse in order to influence the radiation characteristic.

In one embodiment, the row line of a row has two galvanically separated sections, each connected to a group of pixels in the row. The control unit is configured to generate a data signal for each of the two sections. Illustratively, this means that the array is separated into two areas, one of which comprises the first row sections of the rows and the other of which comprises the second row sections of the rows. The areas can be controlled largely independently of each other. It is thus possible to drive the two areas in parallel, which, compared to an embodiment with continuous row lines, can be done at half the speed. It should also be noted that the row line can also be divided into more than two sections.

In one embodiment, the control unit is configured to generate two column pulses for selecting two column lines whose offset from a set pulse traveling along the selected row line is so selected that if at least one of the column pulses is applied to one of the pixels connected to one of the selected column line and the row line, at least a portion of the set pulse is also applied to the same pixel. This allows two pixels to be driven by the same set pulse. Again, selecting two column pulses allows the display device to operate at half the speed.

Advantageously, in the above embodiment, the control unit comprises a first pulse generator that applies the set pulse to one side of the row line and a second pulse generator that applies the reset pulse to the other side of the row line.

The two unipolar pulse generators have a simpler design than bipolar pulse generators. In addition, the unipolar pulses can be wider, which reduces circuit complexity.

In one embodiment, the control unit is configured to select the column lines cyclically successively, so that if a pixel is set to the radiating state in a first cycle and in a subsequent second cycle, it is first reset and set in both cycles when the column pulse is applied. The selection allows the columns to be selected successively one after the other and their pixels to be controlled in the process, so that line-specific control is possible.

In one embodiment, the control unit is configured to successively select the column lines cyclically so that when a pixel is set to the active state in a first cycle and remains therein in the subsequent second state, in the first cycle the data signal comprises only a set pulse and in the second cycle the data signal comprises no reset or set pulse or only a recovery pulse. With this control, the pixel is not reset and newly set each time its column is selected, but remains in its state until reset or only a parasitic charge loss is compensated by recovering in the pixel control. The recovery pulse is smaller than the set pulse with the same polarity.

The reset is performed by a reset pulse. The control unit is configured to successively select the column lines cyclically so that when a pixel is reset from the radiating state to the non-radiating state in one cycle, the data signal comprises only one reset pulse. The described control allows the selective pulse width modulation control, so that periods in which the set pixel radiates and periods in which the reset pixel does not radiate alternate, which corresponds to a pulse width modulation.

In one embodiment, supply lines of two of the rows are galvanically isolated at the array level so that voltage drops in pixel control are negligible and impose lower circuit requirements on the pixel controls.

In one embodiment, the pixel control comprises a charge storage, for example a capacitor, for the energy of the set pulse, the charge amount of the charge storage being limited by a protection diode or circuit arrangement in parallel to the charge storage. The pixel control may be based on a 2T1C structure comprising two transistors and a capacitor.

In one embodiment, the pixel control includes a toggle circuit that returns to an idle state after triggering with the reset pulse after a predetermined time such that the pixel is reset. This toggle circuit allows automatic resetting, for example, after a time period that depends on the circuit dimensions has elapsed, without requiring the application of a reset pulse. Such a toggle circuit can be a mono-flop, for example.

The above described display device and its embodiments allow the control with and the generation of fast pulses. Thereby the duration of the pulses intended for the individual pixels is short.

In the following, the display device is explained in more detail with reference to embodiments and the associated figures.

FIG. 1 schematically shows an embodiment of a display device.

Figure 4:
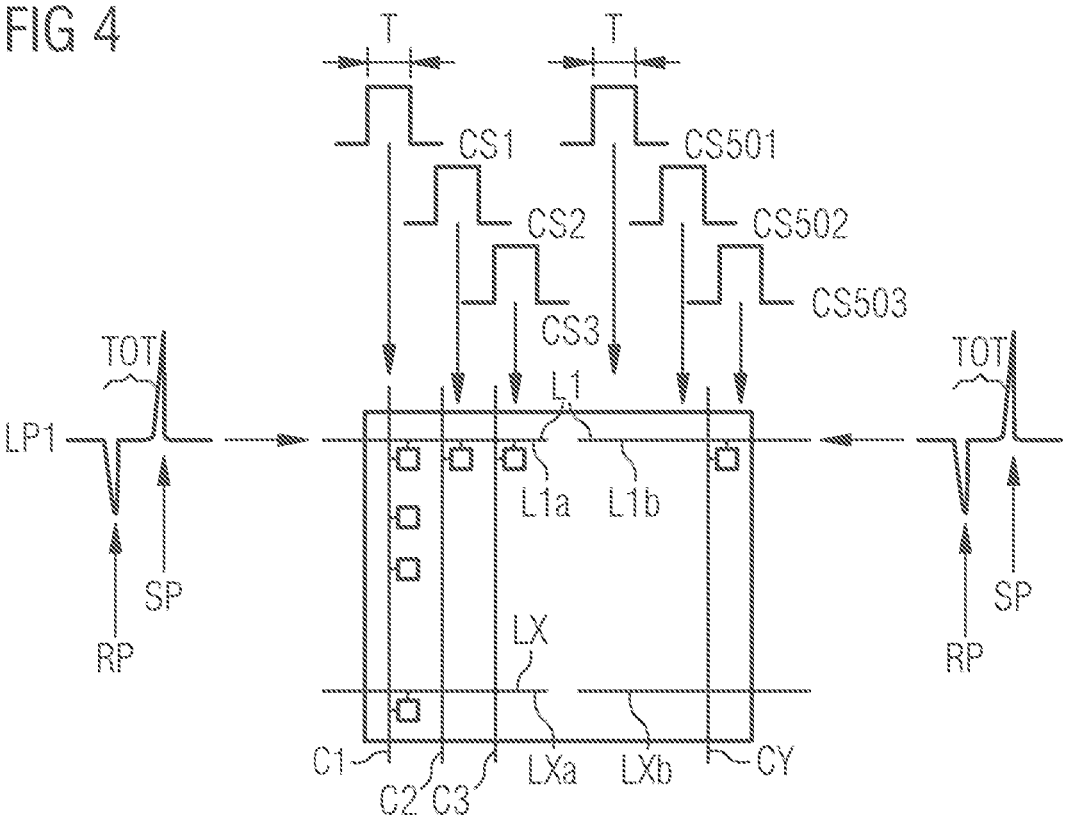

FIG. 4 schematically shows another embodiment of a display device.

Figure 5:
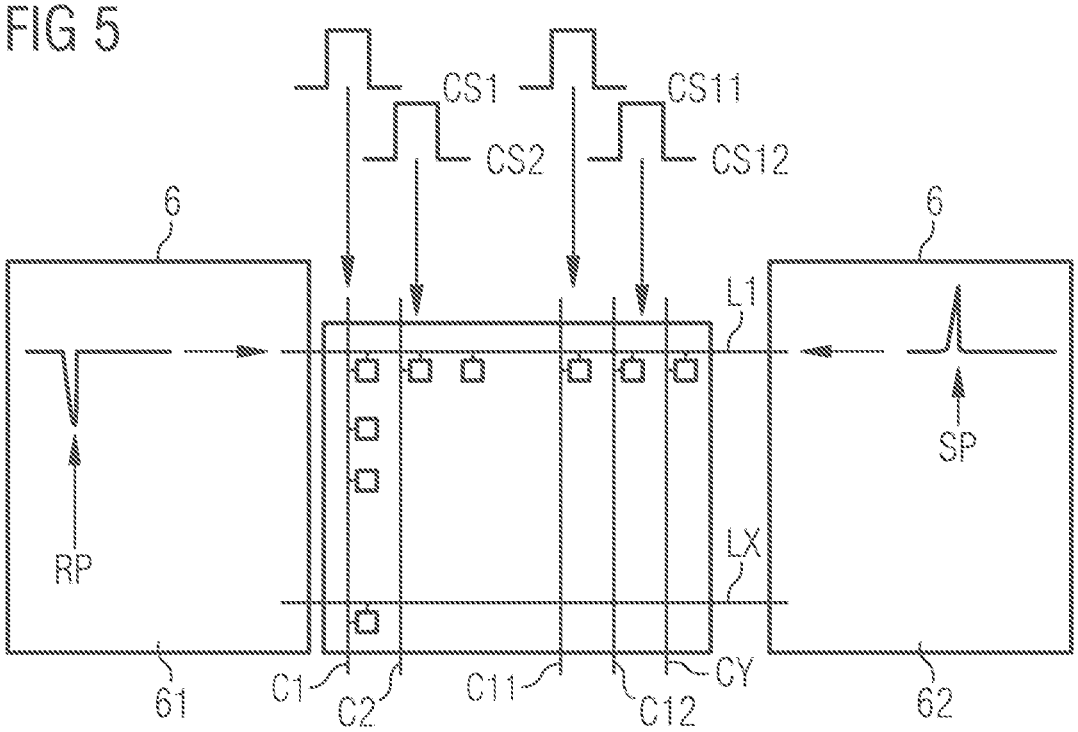

FIG. 5 schematically shows another embodiment of a display device.

Figure 6:
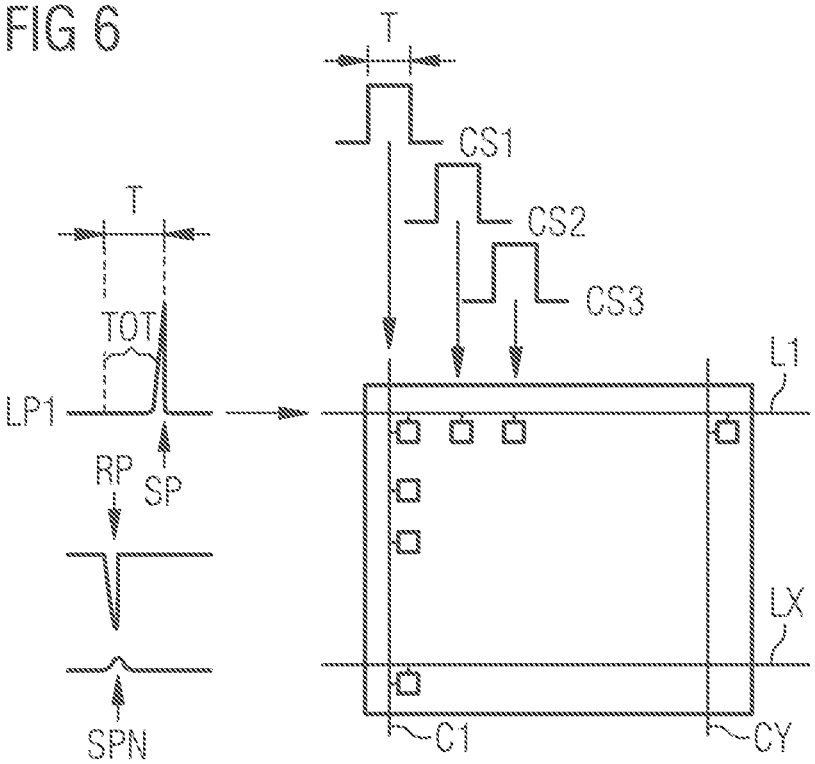

FIG. 6 schematically shows another embodiment of a display device.

Figure 7:
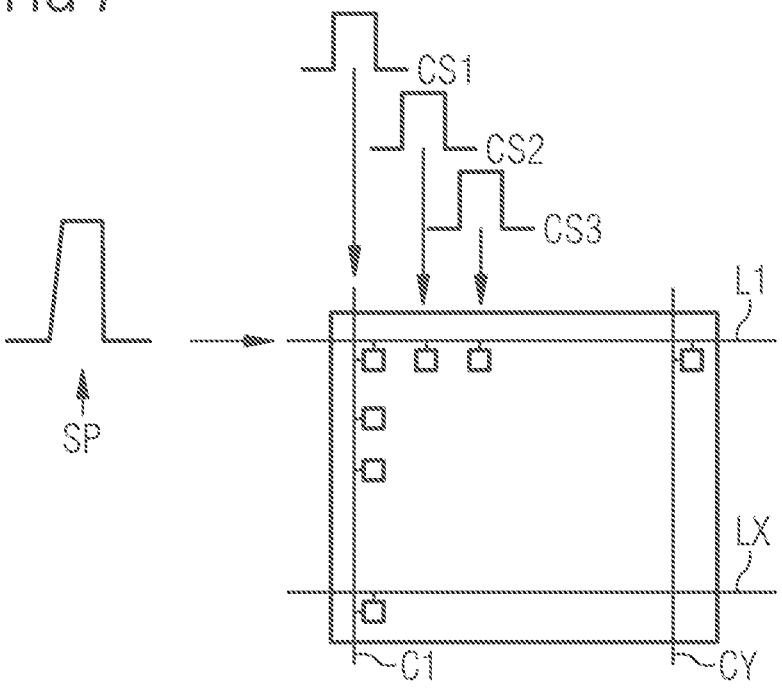

FIG. 7 schematically shows another embodiment of a display device.

Figure 8:
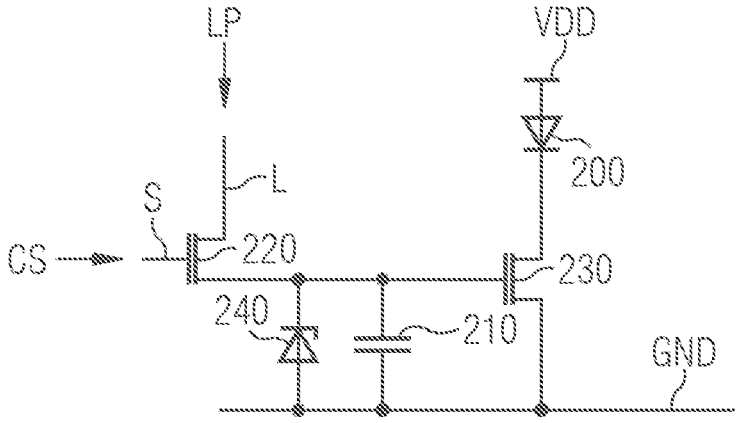

FIG. 8 shows an embodiment of a pixel controller and a light-emitting semiconductor device.

Figure 9:
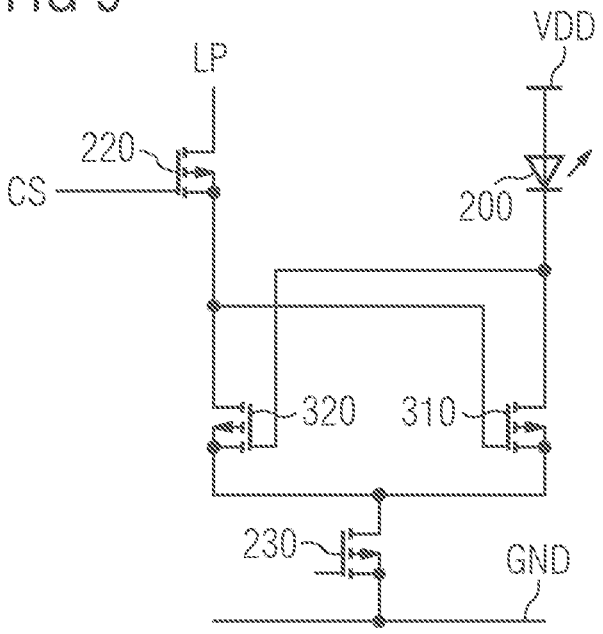

FIG. 9 shows another embodiment of a pixel controller and a light-emitting semiconductor device.

Figure 10:
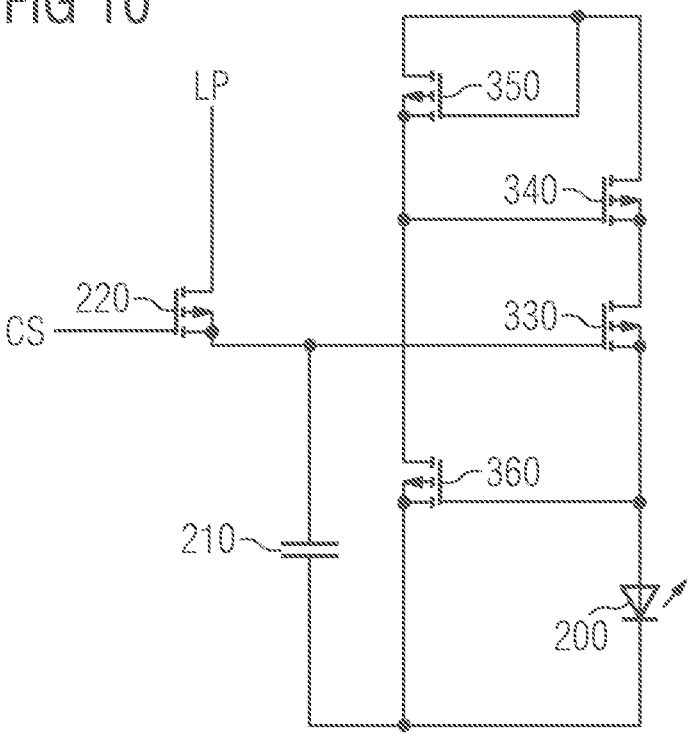

FIG. 10 shows another embodiment of a pixel controller and a light-emitting semiconductor device.

Figure 11:
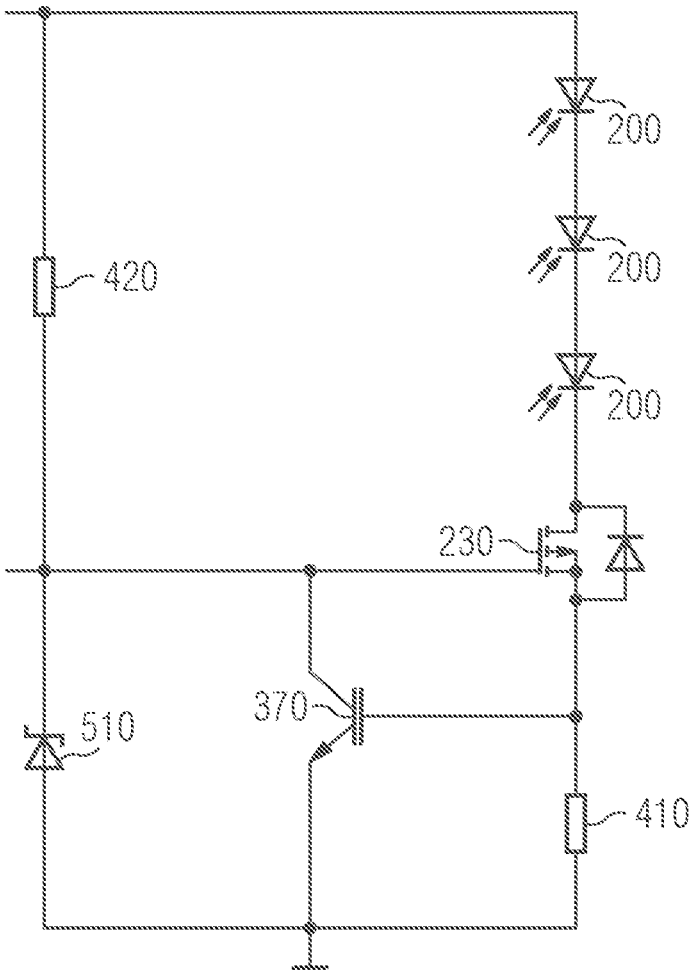

FIG. 11 shows another embodiment of a part of a pixel controller and light emitting semiconductor devices.

Figure 1:
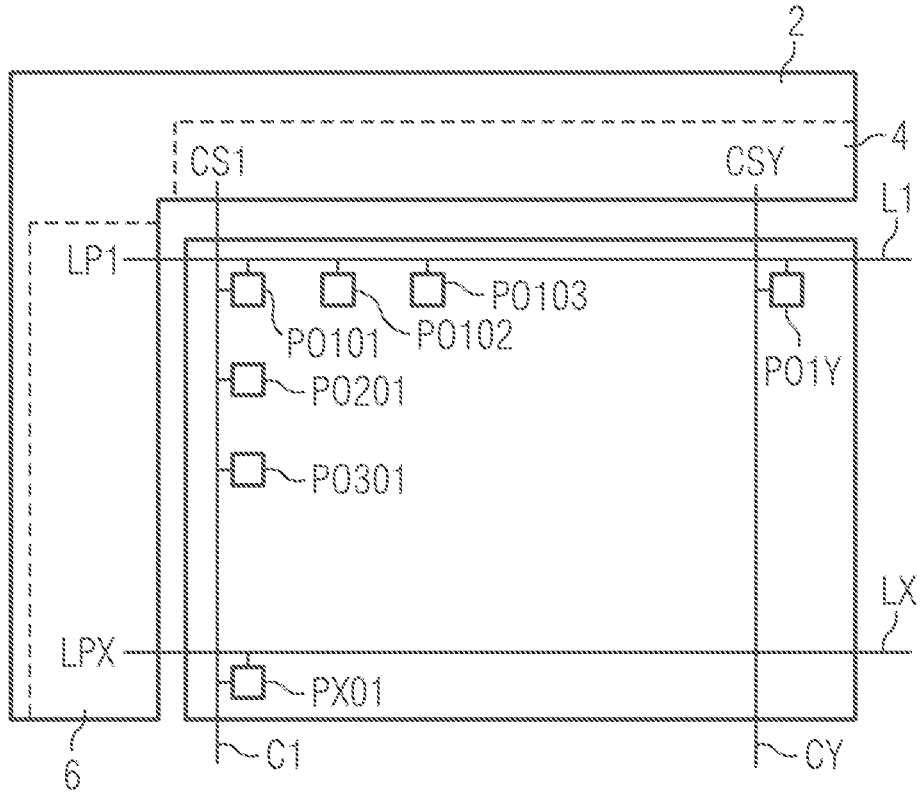

FIG. 1 schematically shows the structure of an embodiment of a display device having a plurality of pixels P0101, P0102, P0103, P01Y, P0201, P0301, PX01 arranged in an array having a plurality of rows, namely X, and a plurality of columns, namely Y. For clarity, not all pixels are shown. The array has X*Y pixels P0101, P0102, P0103, P01Y, P0201, P0301, PX01.

The display device comprises a plurality of row lines L1 . . . LX, not all of which are shown for the sake of clarity. The number of row lines L1 . . . LX is X. Each row line L1 . . . LX is connected to the pixels of one of the rows. For example, the first row line L1 is connected to the pixels P0101, P0102, P0103 . . . P01Y in the first row.

The display device comprises a plurality of column lines C1 . . . CY, not all of which are shown for clarity. The number of column lines C1 . . . CY is Y. Each column line C1 . . . CY is connected to the pixels of one of the columns. Thus, the first column line C1 is connected to the pixels P0101, P0201, P0301 . . . PX01 in the first column.

A control unit 2 is provided for driving the pixels. It is connected to the plurality of column lines C1 . . . CY and adapted to generate column signals CS1 . . . CSY for the column lines C1 . . . CY, and it is connected to the plurality of row lines L1 . . . LX and adapted to generate data signals LP1 . . . LPX for the row lines L1 . . . LX.

Each of the pixels P0101, P0102, P0103, P01Y, P0201, P0301, PX01 is connected to one of the row lines L1, LX and one of the column lines C1, CY and can be controlled by selecting the column line C1, CY connected to it by means of a column signal CS1, CSY and simultaneously applying a data signal LP1, LPX to the row line L1, LX connected to the selected pixel, so that the pixels emit light in the desired manner, i.e. in a manner dependent on the data signal LP1, LPX. The column signals CS1, CSY are generated by means of a column signal generator 4 for the plurality of column lines C1 . . . CY in such a way that a column pulse is applied to a column line in order to select it. The data signals LP1 . . . LPX are generated by means of a row signal generator 6 connected to the plurality of row lines L1 . . . LX for driving the pixels in the selected column.

The control of the pixels P0101, P0102, P0103, P01Y, P0201, P0301, PX01 is carried out column by column by selecting the columns cyclically successively and applying a data signal to the selected pixels of the column if necessary. First the pixels of the first column are controlled, then those of the second column and so on. After the pixels of the Yth column have been controlled, the pixels of the first column are controlled again. The sequence of all controlled columns is called a cycle. The frequency with which the cycles are repeated is called the frame rate.

Figure 2:
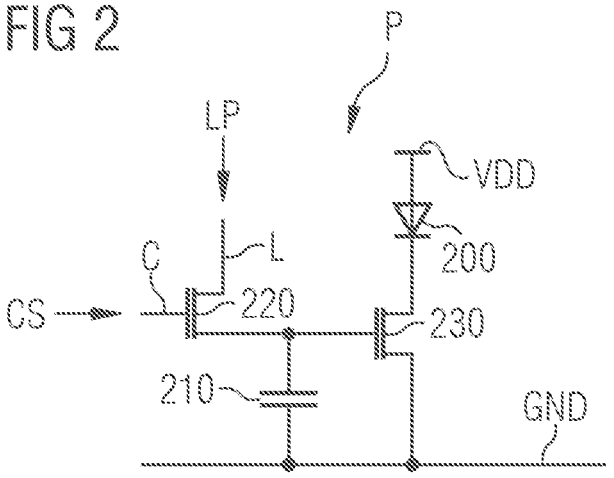
FIG. 2 shows an embodiment of a pixel.

FIG. 2 shows an embodiment of a pixel P from the array having a light emitting semiconductor device 200, for example, an LED or a μLED, and a pixel controller by means of which a current for driving the light emitting semiconductor device 200 is adjusted. The light emission depends on the current that is set. If no current flows, no light emission occurs.

A capacitor 210, a switching transistor 220 and a driver transistor 230 are assigned to the semiconductor component 200 for control. In addition, a row line L, via which data LP is applied, a column line C for switching by means of a column signal CS and two supply lines for a supply potential VDD and a reference potential GND are assigned to the pixel P for control. The switching transistor 220 is arranged to apply a voltage to the capacitor 210 and thus to charge or discharge it. The capacitor 210 is arranged to provide a voltage controlling the driver transistor 230, which in turn can be used to adjust the current through the driver transistor 230 and the semiconductor device 200. The capacitor 210 is used as an analog storage element. In this embodiment, a common anode and an n-FET are used in the pixel control. Other transistor structures and thus polarizations are conceivable.

The pixel drive described above is also called a 2T1C structure because it has two transistors and a capacitor.

Figure 3:
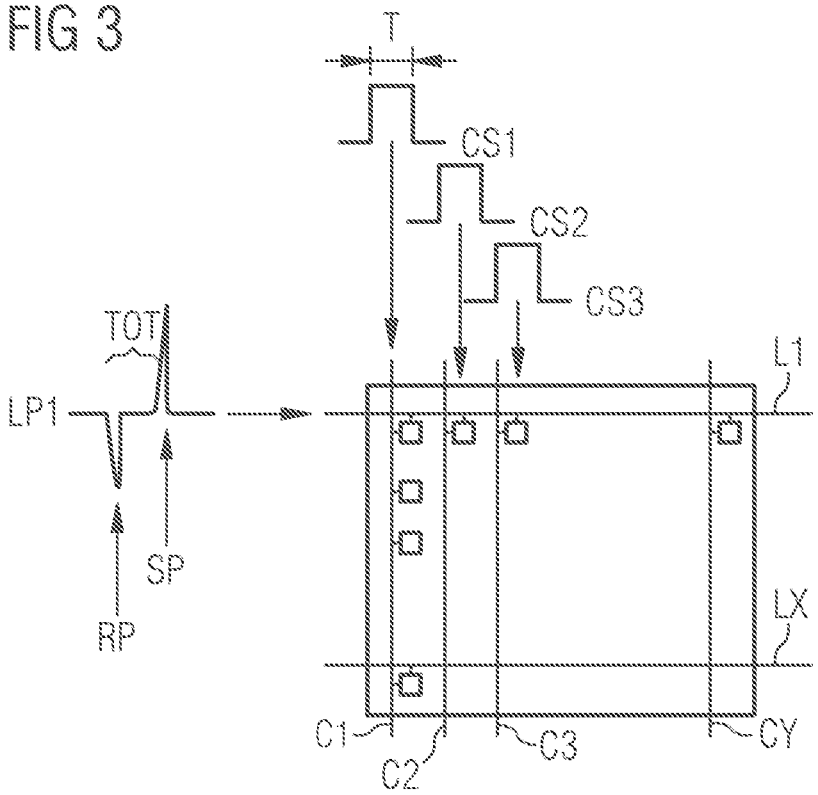
FIG. 3 shows a schematic embodiment of a display device.

FIG. 3 shows an embodiment of a display device with a plurality of pixels arranged in rows and columns, as already described in connection with FIG. 1. The control unit 2 has been omitted for the sake of clarity.

In this embodiment 1000 columns are provided, which are cyclically selected successively by applying a rectangular column pulse as column signal CS1, CS2, CS3 to one column line C1, C2, C3 each. With a frame rate of 60 Hz and 1000 columns (Y=1000), this results in a column pulse width T=1/60/1000 of 16.6 μs. In this time window, the pixels of the selected column can be controlled by applying data signals to the row lines. FIG. 3 shows an example of a data signal LP1 applied to the first row line L1.

The data signal LP1 comprises a sequence of a reset pulse RP with negative amplitude and a set pulse SP with positive amplitude. The duration of the sequence is such that both the reset pulse RP and the set pulse SP are present at the pixel as long as the column pulse CS1 is present. In other words, the sequence of reset pulse RP and set pulse SP is shorter than or equal to the column pulse width T.

The reset pulse RP causes the pixel to be set to a non-light emitting state, so it can also be referred to as an off pulse. It causes the capacitor 210 in the pixel control to be discharged to put it into a well-defined state. The set pulse SP causes the pixel to be set to a light emitting state, so it can also be referred to as a turn-on pulse. It charges the capacitor 210 so that, depending on the amplitude level, and thus the amount of charge charged on the capacitor 210, the current through the light emitting semiconductor device 200 and thus its radiation is adjusted.

During the time period from the start of the reset pulse RP to the start of the set pulse SP, the semiconductor device 200 does not emit light. This time period is also referred to as the turn-on time TOT. It can be set by the control unit 2. A short turn-on time TOT with a small interval between the reset pulse and the set pulse causes the semiconductor device 200 to emit light for a longer period during the pulse duration T than is the case with a long turn-on time TOT with a larger interval between the reset pulse and the set pulse. After the end of the set pulse SP, the pixel remains in the light emitting state because the charge applied to the capacitor 200 during the set still controls the current flow through the semiconductor device 200 in an unchanged manner. The next pixel in the row can be similarly controlled by applying the next set pulse SP. If a pixel is no longer to be lit, only the reset pulse RP can be applied as the data signal.

Due to the amplitude level and the setting of the turn-on time TOT, two degrees of freedom are available for setting the pixel brightness and radiation duration. Resetting and setting is performed while a column pulse is present.

During the column pulse, which is 16.6 μs in this embodiment, the pixel control electronics are discharged and, if necessary, recharged. During at least a portion of this time period, whether analog or digitally discretized, current may flow through the light emitting semiconductor device 200 and the light emitting semiconductor device 200 emits light. The ratio of the on-time, in which light is emitted, to the sum of the on-time and off-time, in which no light is emitted, then results in the duty cycle, which is, for example, a value for the set gray level.

In one embodiment, the supply lines for supply and reference potential VDD, GND of two of the lines to which the same potential is applied are galvanically isolated at array level. In other words, the supply lines for the supply potential VDD and the reference potential GND for each row are galvanically isolated from those of another row. Alternatively, it can be provided that the supply lines for the supply potential VDD and the reference potential GND for one group of rows are galvanically isolated from those of another group of rows. With such a setup, voltage drops on the common supply potential or reference potential line are negligible. Only one pixel per line is selected at a time. In such a case, the pixel control can be configured as a 2T1C structure as described in FIG. 2, since voltage drops on the common supply potential or reference potential lines are negligible. The electronics of the pixel driver in such an embodiment can be TFT-based (e.g. IGZO, LTPS) or silicon-based (e.g. crystalline, ASIC).

It should also be noted that the circuit advantages result in an increased space requirement for the separate supply lines in each row.

FIG. 4 shows another example of a display device. To avoid repetition, the description focuses on differences from the previous embodiment in FIG. 3.

The row line L1 . . . LX of each row have two sections L1*a* . . . LXa and L1*b* . . . LXb separated from each other. The sections L1*a* . . . LXa and L1*b* . . . LXb are each connected to a group of pixels in the row. With 1000 columns, in this embodiment, 500 pixels are provided in the first section L1*a* . . . LXa of each row in the first to the five hundredth column. In the second section of each row L1*b* . . . LXb, 500 pixels are also provided in the five hundredth to the thousandth column.

The data signal generator 6 (not shown in FIG. 4) is configured to generate a data signal for each of the two sections so that a column in the first group and a column in the second group can be selected simultaneously and their pixels reset and set. Exemplarily, the first and five hundredth columns can be selected simultaneously, then the second and five hundredth columns, and so on. Other sequences are conceivable, for example, the first and thousandth columns may be selected simultaneously, then the second and nine hundred and ninety-ninth columns, and so on.

As indicated in FIG. 4, the data signals can be applied on both sides (which corresponds to left and right in FIG. 4) of the row lines L1 . . . LXa and L1*b* . . . LXb separated into sections L1*a* . . . LX.

Since two pixels can be set simultaneously, this results in a larger column pulse width T compared to the previous embodiment for the same number of columns Y and frame rate. It is twice as large for two sections per row line. With a frame rate of 60 Hz and 1000 columns (Y=1000), this results in a pulse width T of 33 μs.

The provision of separate sections of line conductors is usually accompanied by the provision of separate supply conductors for the pixels of the different sections.

Although the data signal generator 6 must generate two pulses simultaneously, which involves increased circuitry, there is more time for reset and set pulse generation and width, which means a reduction in effort for these aspects.

It should be noted that although only two sections L1*a* . . . LXa and L1*b* . . . LXb have been described in the embodiment, embodiments with more than two sections per row line L1 . . . LY are also conceivable.

FIG. 5 shows another example of a display device. In order to avoid repetition, the description concentrates on differences to the embodiment in FIG. 3.

The data signal generator 6 comprises a first pulse generator 61 which applies the reset pulse RP to one side of the row lines L1 . . . LX, and a second pulse generator 62 which applies the set pulse SP to the other side of the row lines L1 . . . LX. Such an arrangement would also be suitable for generating the sequence of reset and set pulses described in connection with FIG. 3 within the column pulse duration required in FIG. 3.

However, this embodiment in FIG. 5 has twice the dynamics of the embodiment described in FIG. 3, where the column pulse duration T is twice as long, i.e. 33 μm. Two column pulses are generated to select two columns, the time spacing of which corresponds to the transit time of the set and reset pulses between the selected columns. The pulse generators 61, 62 can be arranged on the two sides of the row lines L1 . . . LX.

The column pulse at one of the pixels, which is connected to one of the selected column and row lines, is selected in such a way that within the time in which the same column pulse is applied to the pixel, the set pulse PS is also applied to the same pixel in addition to the reset pulse PR, if the pixel is to be set. If both pixels are to be set, the above is the case for both pixels.

During the time when the pulse generators 61, 62 are not generating pulses, the so-called off-time, they are at high impedance so as not to influence the generation of the other pulse. In this way, two pixels can be programmed by the same reset and set pulse RP, SP. The offset of the column pulses relative to the set pulse is selectable, as is the spacing of the reset and set pulses RP, SP and the amplitudes of the set pulse SP, so that the drive level and the brightness of the pixels can also be set. Usually, the same reset and set pulses RP, SP are used to drive pixels that are spaced from one to twenty pixels apart. In FIG. 5, an exemplary distance of ten was selected.

Although two pulse generators 61, 62 are provided, there is more time for reset and set pulse generation and width, which means a reduction in effort for these aspects.

FIG. 6 shows another example of a display device. In order to avoid repetition, the description concentrates on differences to the embodiment in FIG. 3.

The embodiment in FIG. 6 has a higher dynamic, where the columns are scrolled with a much higher frequency than described in FIG. 3. For example, the example in FIG. 6 has an x-fold frame rate, so that at x=256 and a frame rate of 256*60

In this embodiment, however, while the column signal pulse is applied to the pixel, a sequence of reset and set pulses is not applied, but while the column pulse is applied to the pixel, either a set pulse SP or a reset pulse RP is applied to the pixel. The pixel, if it is to remain in the radiating state, is not reset and newly set in the next cycle, but can remain in the radiating state for several cycles without newly setting. Here, too, the degree of actuation can be adjusted by the offset of the column pulse and the set pulse and can thus be changed. The later the set pulse SP occurs within the column pulse duration, the longer the switch-on time TOT.

The reset does not occur until one of the following column pulses is applied to the pixel. If no column pulse is applied, the driver transistor 230 of the pixel control remains conductive and the charge in the capacitor 210 is stored almost indefinitely until it is discharged during one of the next column selection operations. The column line is selected again after 65 μs (that is 1000*65 ns).

The on-time in a time window of 16.6 ms (corresponding to 60 Hz) is n*65 μs+(x−n)*m with m<65 ns, n<256, x=256.

Advantageously, small leakage currents in the pixel control are compensated by a recovery by means of a recovery pulse SPN. The recovery pulse SPN has the same polarity as the set pulse SP, but has a lower amplitude, which only compensates for charge losses at capacitor 210 due to leakage currents.

The pixel is set to the non-radiating state by a reset pulse RP while the column pulse is applied to the pixel. The data signals SP, RP, SPN mentioned are sketched as an example in FIG. 6. If no pulse is generated, the data signal generator 6 has a high impedance.

In one embodiment, a bipolar pulse with reset and set pulses is generated and the control is such that either the reset or set pulse is applied within the column pulse.

The shorter column signal pulses and the targeted setting and resetting allow even finer adjustability of dynamics and brightness. Fine granular tuning of duration and grayscale is possible.

FIG. 7 shows another example of a display device. In order to avoid repetition, the description concentrates on differences to the embodiment in FIG. 6.

In this embodiment, resetting of the pixels to the non-radiating state occurs after a predetermined time after setting. In other words, a reset pulse is not required. The set pulse SP may have a width that is less than, equal to, or greater than the column pulse. In the latter case, the same set pulse SP can be used to drive several adjacent pixels in a row.

The preset time for resetting can be in the range of the frame rate, so for a column pulse width T=65 ns and 1000 columns 65 μs=1000*65 ns. The time for resetting can be greater in another embodiment.

For example, the on-time in a time window of 16.6 ms (corresponding to 60 Hz) is n*65 μs+(x−n)*m with m<65 ns, n<256, x=256.

This embodiment also allows finer adjustability of dynamics and brightness. Fine granular adjustment of duration and grayscale is possible.

FIG. 8 shows a circuit diagram for an embodiment of a pixel controller and a light-emitting semiconductor device as exemplary pixel electronics.

The embodiment differs from the embodiment shown in FIG. 2 in that a protective diode (English "clamping diode") is connected in parallel with the capacitor 210, which is configured as a Z-diode 240 and which limits the voltage applied to the capacitor 210. In this simple form of pixel electronics, voltage limiting and current pinning occurs even when the gate terminal of the driver transistor 230 is fully driven with the set pulse SP as the data signal LP. The current is limited by the LED 200, consequently set to a fixed value and largely independent of the amplitude, provided that the set pulse SP has sufficient energy.

In addition, this design allows an automatic, albeit slow, reset, since the predetermined amount of charge also determines the time until the capacitor is discharged due to the leakage currents and thus the pixel is reset to the non-radiating state.

FIG. 9 shows a circuit diagram for an embodiment of a pixel drive and a light-emitting semiconductor device 200, namely an LED. The pixel drive enters a non-radiating state after a predetermined time, in which no current flows through the semiconductor device 200. The pixel drive comprises a mono-flop with two transistors 310, 320, which is triggered by the set pulse SP as a data signal LP and returns to a non-radiating state by itself after a time determined by the circuit dimensioning. Bias current limiting, i.e. current spinning, is also present in this circuit arrangement.

A switching transistor 220 and a driver transistor 230 are assigned to the semiconductor component 200 for control. Between the driver transistor 230 and the LED 200, the transistors 310, 320 connected as a mono-flop are provided, which are triggered by the switching transistor 220. In this embodiment, the transistors 220, 230, 310, 320 are N-channel enhancement MOSFETs.

FIG. 10 shows a circuit diagram for an embodiment of a pixel driver and a light emitting semiconductor device 200, namely an LED. The pixel drive also has a toggle circuit that goes into the idle state after a predetermined time, which interrupts the flow of current through the LED 200. A switching transistor 220 and a capacitor 210 are associated with the semiconductor device 200 for driving.

Four transistors 330, 340, 350, 360 are connected in such a way that they are triggered by set pulse SP to allow current flow through LED 200 and the toggle circuit returns to the rest position by itself after a time determined by its dimensioning.

A first and a second transistor 330, 340 are connected in series with the LED 200, with the gate terminal of the first transistor 330 connected to the capacitor 210 so that it acts as a driver capacitor. In parallel with the series connection of the LED 200 and the first and second transistors 330, 340, a third and fourth transistor 350, 360 are connected in series, with the drain and gate terminals of the third transistor 350 connected together. The gate terminal of the fourth transistor 360 is connected between the LED 200 and the first transistor 330. The gate terminal of the second transistor 340 is connected between the third and fourth transistors 350, 360. In this embodiment, the first, third, and fourth transistors 330, 350, 360 are N-channel enhancement MOSFETs, as is the switching transistor 220. The second transistor 340 is formed as a P-channel enhancement MOSFET.

FIG. 11 shows an embodiment of a circuit that also returns to the idle state by itself. In addition to a series of LEDs 200 and the driver transistor 230, a first resistor 410 is connected in series. A transistor 370 is connected in parallel with the gate terminal of the driver transistor 230 and the first resistor 410, and a Z-diode 510 is also connected in parallel. The gate terminal of the transistor 370 is connected between the driver transistor 230 and the first resistor 410. A second resistor 420 is connected in parallel with the LEDs 200 and the gate terminal of the driver transistor 230.

The previously described circuit arrangements are more complex designs with a toggle circuit and can, for example, enable current pinning despite a short set pulse SP. The current is limited by the LED 200 and thus set to a fixed value that is independent of the set pulse SP, provided it has sufficient energy.

The features of the embodiments can be combined with each other. The invention is not limited by the description based on the embodiments to these. Rather, the invention encompasses any new feature as well as any combination of features, which in particular includes any combination of features in the patent claims, even if this feature or combination itself is not explicitly stated in the patent claims or embodiments.

LIST OF REFERENCE SIGNS

2 Control unit
4 Column signal generator
6 Data signal generator
200 Semiconductor device
210 Capacitor
220, 230, 310, 320, 330, 340, 350, 360, 370 Transistor
410, 420 Resistor
240, 510 Z-diode
C, C1 . . . CY Column line
CS, CS1 . . . CSY Column signal
L, L1 . . . LX Row line
LP, LP1 . . . LPX Data signal
P, P0101, P0102, P0103, P01Y, P0201, P0301, PX01 Pixel
VDD, GND Potential
TOT Switch-on time
SP Set pulse
RP Reset pulse
NSP Recovery pulse
T Pulse width

The invention claimed is:

1. A display device, comprising:

a plurality of pixels arranged in an array with rows and columns, a plurality of column lines, each connected to the pixels of one of the columns, a plurality of row lines, each connected to the pixels of one of the rows, and a control unit coupled to the plurality of column lines and configured to generate a column pulse for a selected column line of the plurality of column lines, and connected to the plurality of row lines and configured to generate a data signal for a selected row line from the plurality of row lines, wherein the data signal comprises a set pulse which, when the pixel is set to a radiating state, is applied to the pixel connected to the selected column and row line at least in a portion when the column pulse is applied to the pixel, and drives the pixel such that a light emission of the pixel depends on the time offset between the column pulse and the set pulse, wherein the plurality of pixels each comprise a light emitting semiconductor device and a pixel controller, and wherein the pixel controller comprises a charge storage for the energy of the set pulse, the charge amount of the charge storage being limited by a protection diode or circuitry in parallel with the charge storage.

2. The display device according to claim 1, wherein the control unit is configured to set the time offset between the start of the column pulse and the start of the set pulse.

3. The display device according to claim 1, wherein the light emission depends on the amplitude of the set pulse and the control unit is configured to set the amplitude of the set pulse.

4. The display device according to claim 1, wherein the control unit is configured to reset the pixel before further setting the pixel so that the pixel is in a non-radiating state.

5. The display device according to claim 4, wherein the control unit is configured to reset the pixel as soon as a reset pulse is applied to the pixel, when a column pulse is applied to the pixel.

6. The display device according to claim 4, wherein the pixel is configured to reset with a time interval from setting.

7. The display device according to claim 4, wherein the control unit is configured to generate as a data signal a bipolar pulse having a sequence with the reset pulse followed by the set pulse, wherein when the column pulse is applied to the pixel, at least a portion of the sequence is also applied to the pixel.

8. The display device according to claim 4, wherein the control unit is configured to set the distance between the reset pulse and the set pulse.

9. The display device according to claim 4, wherein the pixel is configured to reset with a time interval from setting, wherein the pixel is switched off automatically after a preset time.

10. The display device according to claim 1, wherein the row line of a row comprises two galvanically separated sections, each connected to a group of pixels in the row, and wherein the control unit is configured to generate a data signal for each of the two sections.

11. The display device according to claim 1, wherein the control unit is configured to generate two column pulses for the selection of two column lines, the offset of which to a set pulse running along the selected row line is selected such that when at least one of the column pulses is applied to one of the pixels connected to one of the selected column line and the row line, at least a portion of the set pulse is also applied to the same pixel.

12. The display device according to claim 1, wherein the control unit comprises a first pulse generator applying the set pulse to one side of the row line and a second pulse generator applying the reset pulse to the other side of the row line.

13. The display device according to claim 1, wherein the control unit is configured to cyclically successively select the column lines so that when a pixel is set to the radiating state in a first cycle and in a subsequent second cycle, the pixel is first reset and set in both cycles when the column pulse is applied.

14. The display device according to claim 1, wherein the control unit is configured to cyclically successively select the column lines so that when a pixel is set to the active state in a first cycle and remains therein in the subsequent second state, in the first cycle the data signal comprises a set pulse and in the second cycle the data signal comprises no reset or set pulse or comprises only a recovery pulse.

15. The display device according to claim 1, wherein the control unit is configured to cyclically select the column lines successively so that when a pixel is reset from the radiating state to the non-radiating state in one cycle, the data signal comprises only a reset pulse.

16. The display device according to claim 1, wherein supply lines of two of the rows are galvanically isolated on array level.

17. The display device according to claim 1, wherein the pixel controller comprises a flip-flop circuit which returns to a rest state after being triggered with the set pulse after a predetermined time so that the pixel is reset.

18. A display device, comprising:

a plurality of pixels arranged in an array with rows and columns, a plurality of column lines, each connected to the pixels of one of the columns, a plurality of row lines, each connected to the pixels of one of the rows, and a control unit coupled to the plurality of column lines and configured to generate a column pulse for a selected column line of the plurality of column lines, and connected to the plurality of row lines and configured to generate a data signal for a selected row line from the plurality of row lines, wherein the data signal comprises a set pulse which, when the pixel is set to a radiating state, is applied to the pixel connected to the selected column and row line at least in a portion when the column pulse is applied to the pixel, and drives the pixel such that a light emission of the pixel depends on the time offset between the column pulse and the set pulse, wherein each pixel of the plurality of pixels comprises a light emitting semiconductor device and a pixel controller, and wherein the pixel controller comprises a toggle circuit which is realized as a mono-flop circuit and which returns to a rest state after a predetermined time after being triggered with the set pulse so that the pixel is automatically reset without a reset pulse.

19. A display device, comprising:

a plurality of pixels arranged in an array with rows and columns, a plurality of column lines, each connected to the pixels of one of the columns, a plurality of row lines, each connected to the pixels of one of the rows, and a control unit coupled to the plurality of column lines and configured to generate a column pulse for a selected column line of the plurality of column lines, and connected to the plurality of row lines and configured to generate a data signal for a selected row line from the plurality of row lines, wherein the data signal comprises a set pulse, wherein each pixel of the plurality of pixels comprises a light emitting semiconductor device and a pixel controller, wherein the pixel controller comprises a charge storage for the energy of the set pulse, and wherein the pixel controller comprises a toggle circuit which is realized as a mono-flop circuit and which returns to a rest state after being triggered with the set pulse so that the pixel is automatically reset without a reset pulse.

* * * * *